US008353542B2

(12) United States Patent
Cumbo

(10) Patent No.: US 8,353,542 B2
(45) Date of Patent: Jan. 15, 2013

(54) CLOSURE LATCH WITH INERTIA MEMBER

(75) Inventor: Francesco Cumbo, Pisa (IT)

(73) Assignee: Magna Closures S.p.A., Collesalvetti (IT)

( * ) Notice: Subject to any disclaimer, the term of this patent is extended or adjusted under 35 U.S.C. 154(b) by 164 days.

(21) Appl. No.: 12/773,393

(22) Filed: May 4, 2010

(65) Prior Publication Data

US 2010/0283268 A1 Nov. 11, 2010

Related U.S. Application Data

(60) Provisional application No. 61/175,591, filed on May 5, 2009.

(51) Int. Cl.
*E05C 3/06* (2006.01)

(52) U.S. Cl. ..... 292/196; 292/230; 292/216

(58) Field of Classification Search ..... 292/336.3, 292/DIG. 3, DIG. 67, DIG. 23, 230, 237, 292/216

See application file for complete search history.

(56) References Cited

U.S. PATENT DOCUMENTS

| | | | | |
|---|---|---|---|---|
| 2,864,641 | A * | 12/1958 | Leslie | 292/336.3 |
| 5,865,481 | A * | 2/1999 | Buschmann | 292/216 |
| 6,010,165 | A * | 1/2000 | Santarelli et al. | 292/216 |
| 6,053,543 | A * | 4/2000 | Arabia et al. | 292/201 |
| 7,111,880 | B2 * | 9/2006 | Saitoh | 292/336.3 |
| 7,232,164 | B2 * | 6/2007 | Lee | 292/336.3 |
| 7,478,848 | B2 * | 1/2009 | Kim | 292/336.3 |
| 7,568,744 | B2 * | 8/2009 | Tenorio et al. | 292/336.3 |
| 7,607,702 | B2 * | 10/2009 | Pereverzev | 292/216 |
| 2007/0120382 | A1 * | 5/2007 | Chevalier | 292/336.3 |
| 2009/0102206 | A1 * | 4/2009 | Lee | 292/336.3 |
| 2009/0322105 | A1 * | 12/2009 | Lee et al. | 292/237 |

* cited by examiner

*Primary Examiner* — Carlos Lugo
*Assistant Examiner* — Mark Williams
(74) *Attorney, Agent, or Firm* — Miller Canfield

(57) ABSTRACT

In one aspect, the invention is directed to a closure latch for a vehicle door, wherein during a crash event, the closure latch has an inertia member that prevents the vehicle door from opening. The inertia member may only temporarily prevent the vehicle door from opening, or alternatively it may cause a lock lever to move to a locked position, so that the vehicle door remains locked even after the inertia member is no longer actuated.

11 Claims, 7 Drawing Sheets

CLOSURE LATCH WITH INERTIA MEMBER

This application claims the benefits of U.S. Provisional Application No. 61/175,591, filed May 5, 2009.

FIELD OF THE INVENTION

The present invention relates to a closure latch for a vehicle door, and more particularly to a closure latch for a vehicle door that is configured to prevent the door from opening during a vehicle crash event.

BACKGROUND OF THE INVENTION

In vehicle door closure latches it is beneficial to at least temporarily prevent the vehicle door from opening during a crash event, so as to reduce the likelihood of a vehicle occupant from being thrown from the vehicle. Several systems have been proposed for this purpose. In at least some cases, the proposed mechanisms are relatively complex and do not integrate easily into an existing closure latch assembly, requiring the closure latch assembly to be redesigned somewhat to accommodate them.

SUMMARY OF THE INVENTION

In one aspect, the invention is directed to a closure latch for a vehicle door, wherein during a crash event, the closure latch has an inertia member that prevents the vehicle door from opening. The inertia member may only temporarily prevent the vehicle door from opening, or alternatively it may cause a lock lever to move to a locked position, so that the vehicle door remains locked even after the inertia member is no longer actuated.

In a particular embodiment, the closure latch includes a ratchet movable between an open position and a closed position and is biased towards the closed position. The closure latch further includes a pawl movable between a ratchet locking position wherein the pawl holds the ratchet in the closed position and a ratchet release position wherein the pawl permits the ratchet to move to the open position. The pawl is biased towards the ratchet locking position. The closure latch further includes a lock link movable between an unlocked position wherein the lock link operatively connects an outside door release lever and the pawl, and a locked position wherein the lock link operatively disconnects the outside door release lever and the pawl. The lock link is biased towards the unlocked position. The closure latch further includes an inertia lever pivotable about an inertia lever pivot. The inertia lever is movable between a home position wherein the inertia lever permits the lock link to be in the unlocked position, and an actuated position wherein the inertia lever moves the lock link to the locked position. The inertia lever is movable to the actuated position by an actuation force that is at least a selected magnitude acting in a selected direction at the pivot. The inertia lever is biased towards the home position.

In another embodiment, the closure latch includes a ratchet movable between an open position and a closed position and biased towards the open position. The closure latch further includes a pawl movable between a ratchet locking position wherein the pawl holds the ratchet in the closed position and a ratchet release position wherein the pawl permits the ratchet to move to the open position. The pawl is biased towards the ratchet locking position. The closure latch further includes an inside door release lever movable between a home position wherein the inside door release lever permits movement of the pawl to the ratchet locking position, and a pawl release position wherein the inside door release lever moves the pawl to the ratchet release position. The inside door release lever is biased towards the home position. The closure latch further includes a lock link pivotable about a lock link pivot between an unlocked position wherein the lock link operatively connects an outside door release lever and the pawl, and a locked position wherein the lock link operatively disconnects the outside door release lever and the pawl. The lock link is biased towards the unlocked position. The lock link is movable to the locked position by an actuation force that is at least a selected magnitude acting in a selected direction at the lock link pivot.

BRIEF DESCRIPTION OF THE DRAWINGS

The present invention will now be described by way of example only with reference to the attached drawings, in which.

DETAILED DESCRIPTION OF THE INVENTION

Figure 1A:
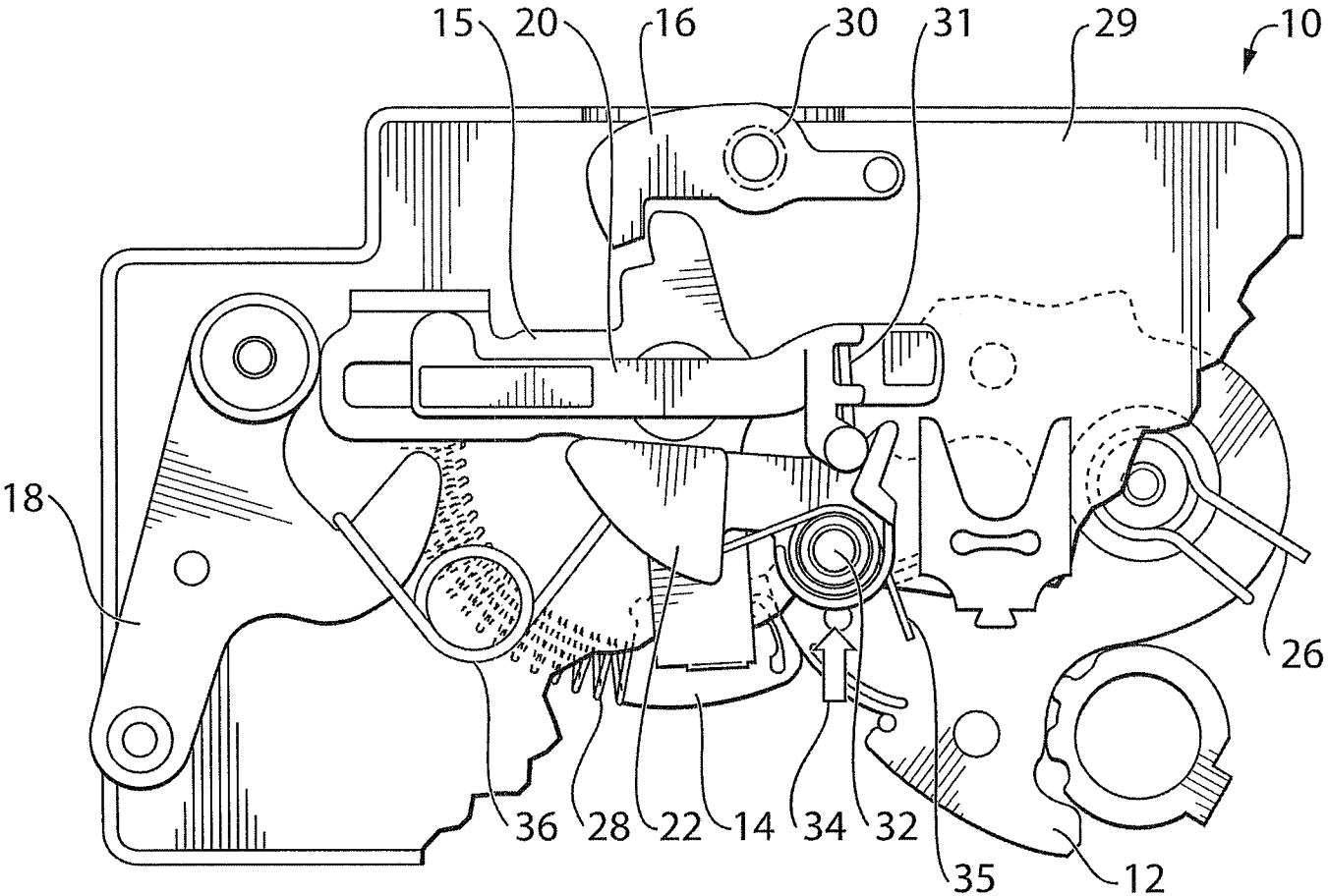
FIG. 1*a* is a plan view of a closure latch for a vehicle door in accordance with an embodiment of the present invention, showing an inertia lever in a home position.
Figure 1B:
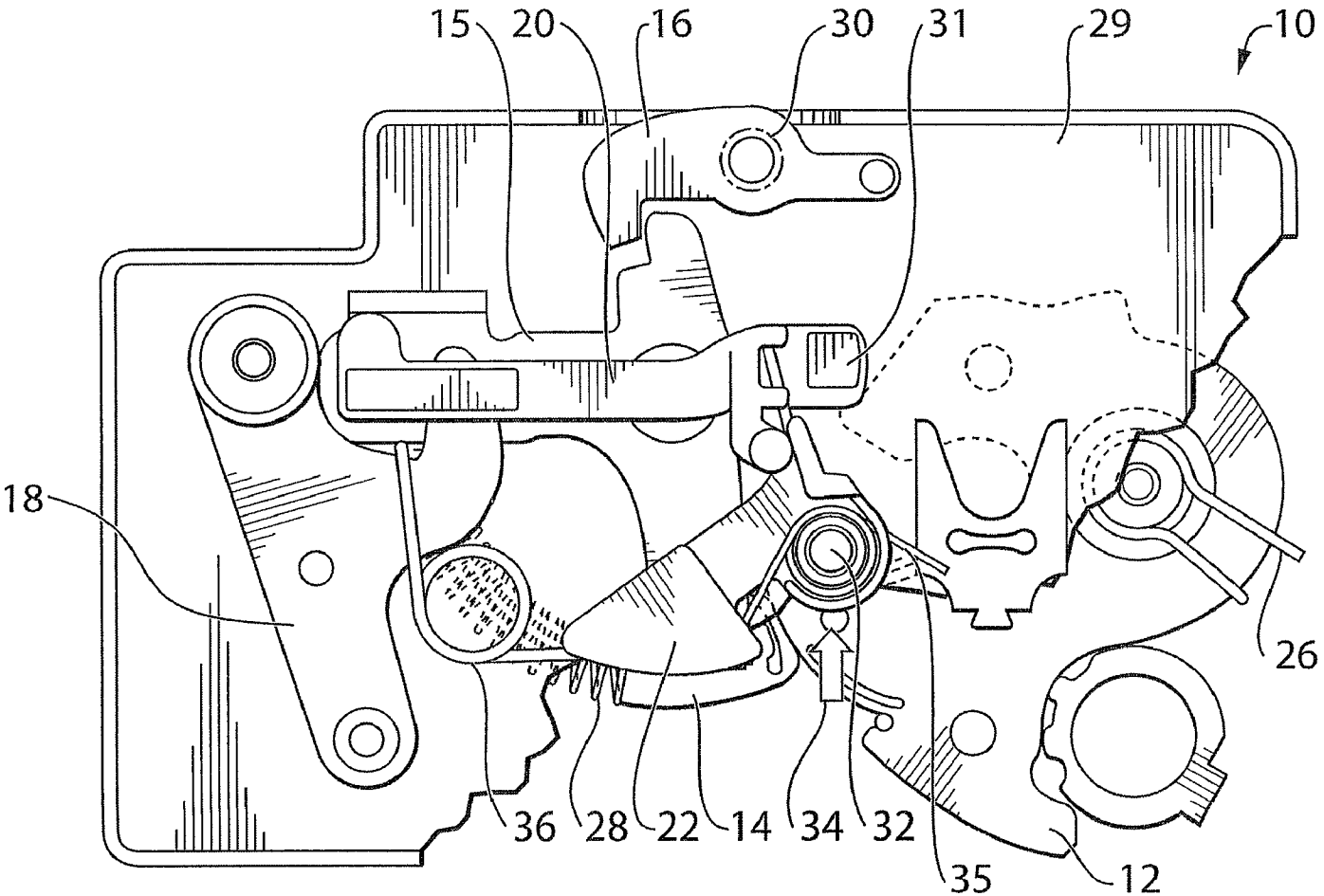
FIG. 1*b* is a plan view of the vehicle latch shown in FIG. 1*a*, showing the inertia lever in an actuated position (e.g. during a vehicle crash event)

Reference is made to FIGS. 1*a* and 1*b*, which show a closure latch 10 for a door (not shown) of a vehicle (not shown), in accordance with an embodiment of the present invention. The closure latch 10 includes a ratchet 12, a pawl 14, a pawl lever 15, an inside door release lever 16, an outside door release lever 18, a lock link 20 and an inertia member 22, which is preferably a lever, and which may be referred to as an inertia lever in applicable embodiments.

The ratchet 12 is movable between a closed position (shown in FIGS. 1*a* and 1*b*) wherein the ratchet 12 retains a striker (not shown) mounted on the body (not shown) of the vehicle and an open position (not shown) wherein the ratchet 12 is unengaged with the striker. A ratchet biasing member 26 such as a suitable spring may be provided to bias the ratchet 12 towards the open position.

The pawl 14 is movable between a ratchet locking position (FIG. 1*a*) wherein the pawl 14 holds the ratchet 12 in the closed position, and a ratchet release position (not shown) wherein the pawl 14 permits the ratchet 12 to move to its open position. A pawl biasing member 28 such as a suitable spring may be provided to bias the pawl 14 towards the ratchet locking position.

The ratchet 12 and pawl 14 are positioned on one side of a wall 29 that is part of the housing for the closure latch 10. The pawl lever 15 is connected to the pawl 14 and operatively connects components on the other side of the wall 29 to the pawl 14.

The inside door release lever 16 may be operatively connected to the ratchet 12 for movement from the closed position to the open position. For example, the inside door release lever 16 may be movable between an inside door release lever home position (FIGS. 1*a* and 1*b*) wherein the inside door release lever 16 permits the ratchet 12 to be in the closed position, and an inside door release lever pawl release position wherein the inside door release lever 16 moves the pawl lever 15 and thereby moves the pawl 14 to the ratchet release position so that the ratchet 12 can move from the closed position to the open position.

An inside door release lever biasing member 30, such as a suitable spring, may be provided to bias the inside door release lever 16 towards its home position.

The lock link 20 is movable between an unlocked position (FIG. 1*a*) and a locked position (FIG. 1*b*). In the unlocked position the lock link 20 operatively connects the outside door release lever 18 to the pawl 14 (through the pawl lever 15). As a result, movement of the outside door release lever 18 from a home position (FIG. 1*a*) to an actuated position causes the pawl 14 to move to the ratchet release position thereby releasing the ratchet 12.

In the locked position (FIG. 1*b*) the lock link 20 operatively disconnects the outside door release lever 18 and the pawl 14. As a result, movement of the outside door release lever 18 to the actuated position (FIG. 1*b*) does not cause movement of the pawl 14 out of the ratchet locking position.

A lock link biasing member 31, such as a suitable spring, may be provided to bias the lock link 20 to the unlocked position.

The inertia lever 22 is pivotable about an inertia lever pivot 32 and, as a result of its weight distribution, is movable from a home position (FIG. 1*a*) to an actuated position (FIG. 1*b*) by an actuation force F that is at least a selected magnitude and that acts in a selected direction (represented by arrow 34) on the pivot 32. Such an actuation force F might arise in the event of a lateral impact, or in other crash event that generates a lateral force component.

When the inertia lever 22 is in the home position (FIG. 1*a*) it permits the lock link 20 to be in the unlocked position. When the inertia lever 22 is in the actuated position (FIG. 1*b*) it moves the lock link 20 to the locked position. As a result, movement of the outside door release lever 18 to the actuated position does not cause the release of the ratchet 12 and consequent opening of the vehicle door (not shown). As a result, if, during a crash event, there is sufficient force to cause the outside door handle (not shown) or the outside door release lever 18 to be actuated, the movement of the inertia lever 22 would prevent such an occurrence from opening the vehicle door, thereby making it less likely that a vehicle occupant will be thrown from the vehicle (not shown) during a crash event.

After the forces of a crash event have subsided, there are no longer forces urging the inertia lever 22 to its actuated position. An inertia lever biasing member 35, such as a suitable spring, may be provided to bias the inertia lever 22 to its home position. Additionally, the lock link 20 may return to its unlocked position under the urging of the lock link biasing member 31.

Instead of providing a dedicated biasing member 35, the movement of the lock link 20 to its unlocked position could alternatively be used to move the inertia lever 22 to its home position. Thus the lock link biasing member 31 would also be an inertia lever biasing member that biases the inertia lever 22 towards its home position.

An outside door release lever biasing member 36, such as a suitable spring, may be provided to bias the outside door release lever 18 towards its rest position.

A benefit of the arrangement shown in FIGS. 1*a* and 1*b* is that the inertia lever 22 may be provided with the closure latch 10 or may be omitted from the closure latch 10 without compromising the other functions of the closure latch. In other words, it is easy to add or omit from the closure latch 10 as desired.

Figure 2A:
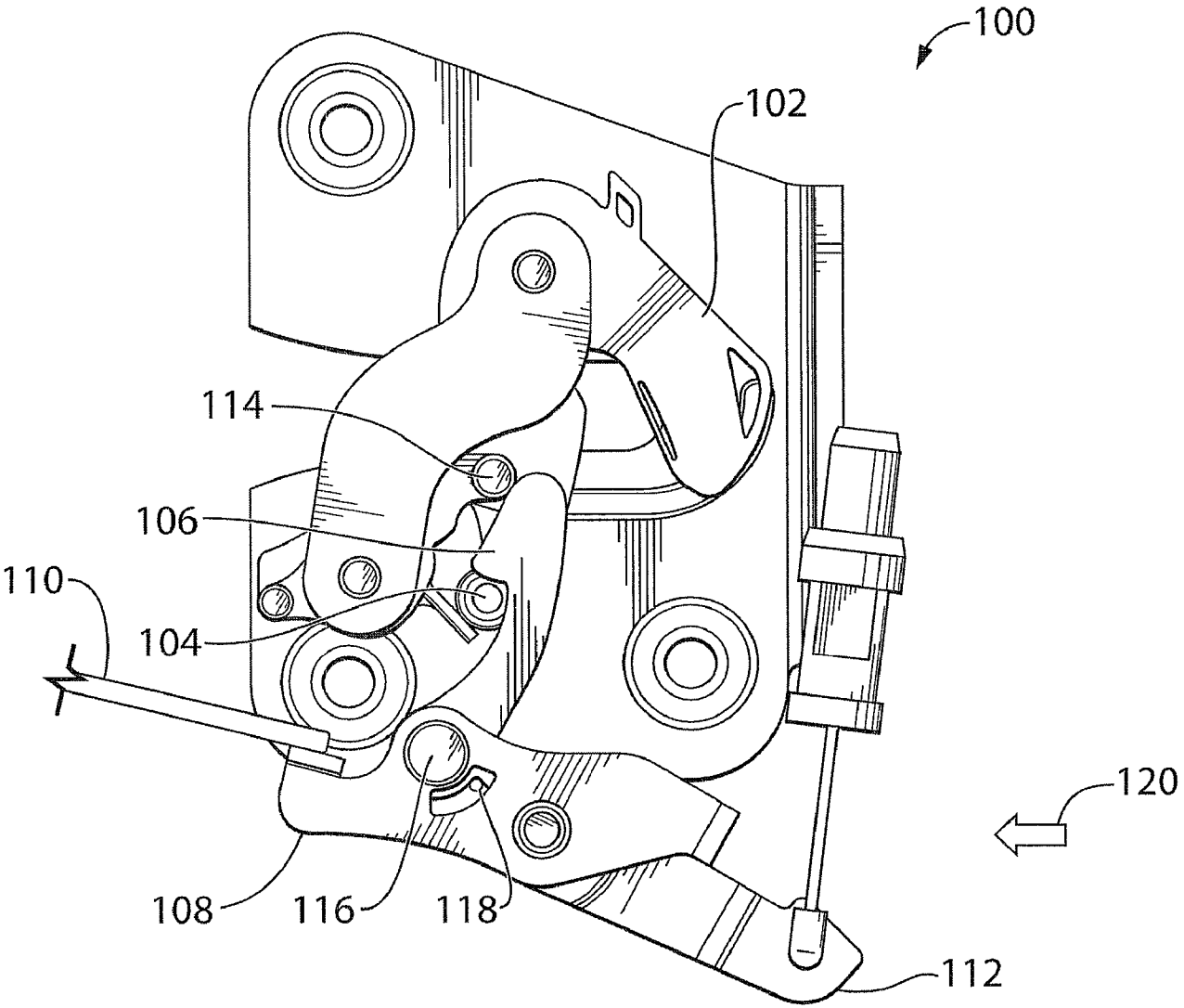
FIG. 2*a* is a plan view of a closure latch in accordance with another embodiment of the present invention, showing an inertia lever in a home position.
Figure 2B:
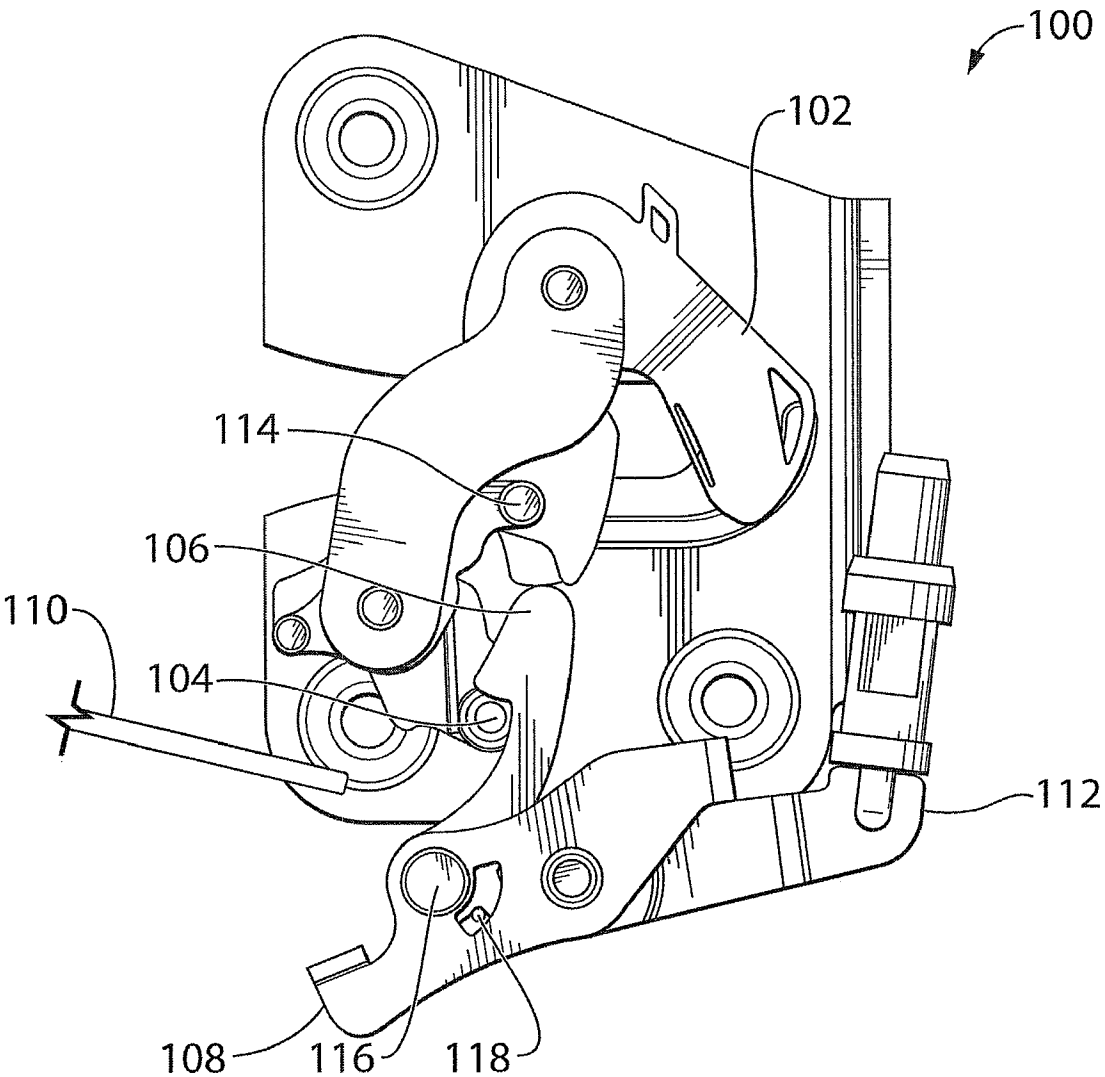
FIG. 2*b* is a plan view of the closure latch shown in FIG. 2*a*, showing the actuation of an outside door release lever.
Figure 2C:
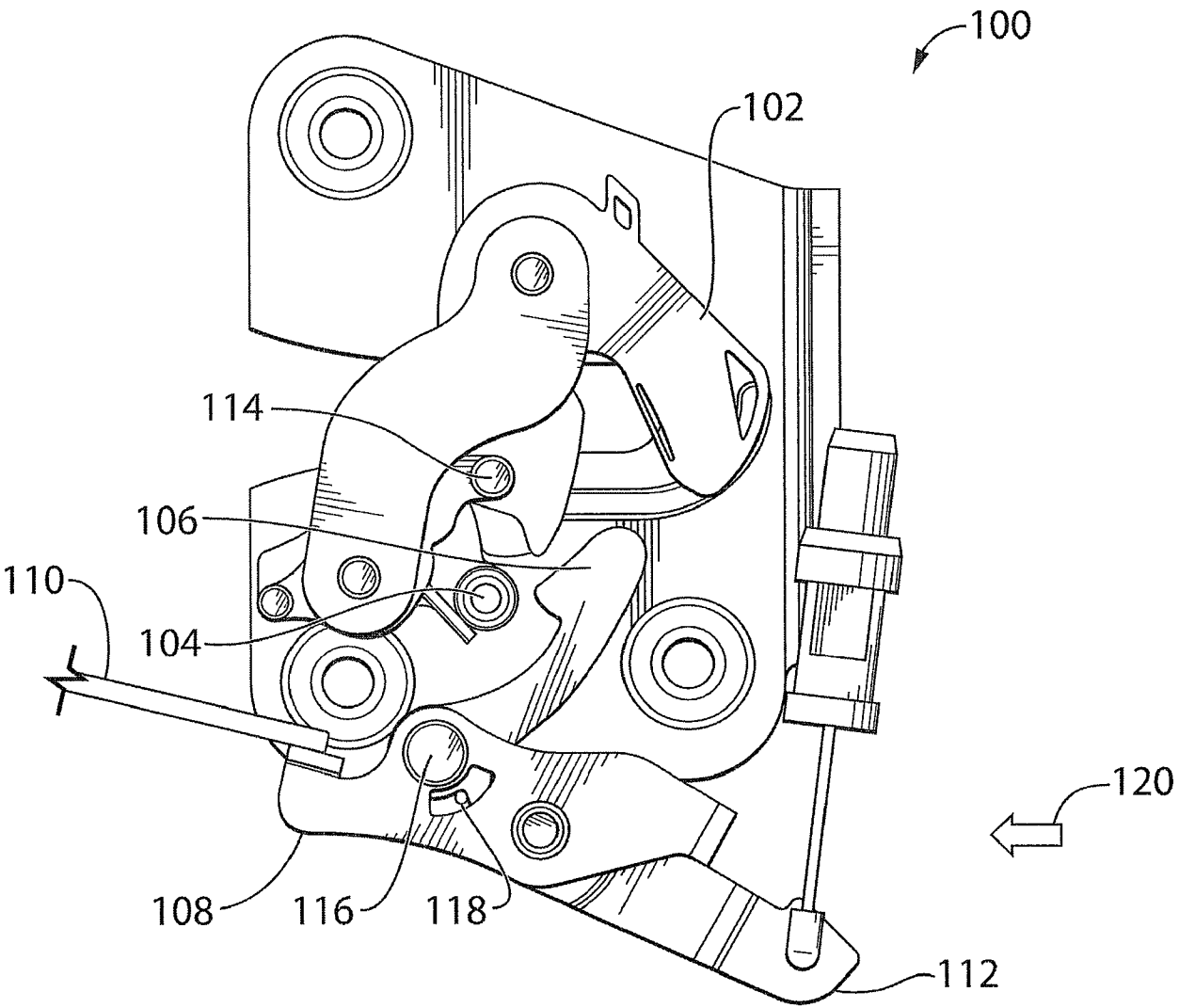
FIG. 2*c* is a plan view of the closure latch shown in FIG. 2*a*, showing the inertia lever in an actuated position.

Reference is made to FIGS. 2*a*, 2*b* and 2*c*, which show a closure latch 100 in accordance with another embodiment of the present invention. The closure latch 100 includes a ratchet 102, a pawl 104, a lock link 106, a lock link actuator 108, an inside door release lever 110, an outside door release lever 112 and a lock lever 114. The ratchet 102 and pawl 104 may be similar to the ratchet 12 and pawl 14 respectively (FIG. 1*a*). The lock link 106 may be pivotable about a lock link pivot 116 between an unlocked position (FIG. 2*a*) and a locked position (FIG. 2*c*). In the unlocked position, the lock link 106 is movable by the lock link actuator 108 to move the pawl to a ratchet release position (FIG. 2*b*). Thus, in the unlocked position, the lock link 106 operatively connects the lock link actuator 108 (and accordingly the inside and outside door release levers 110 and 112) to the pawl 104. In the locked position (FIG. 2*c*), the lock link 106 operatively disconnects the lock link actuator 108 (and accordingly the inside and outside door release levers 110 and 112) from the pawl 104.

A lock link biasing member 118, such as a suitable spring, may be provided to bias the lock link 106 to the unlocked position.

The lock lever 114 is movable between an unlocked position (FIGS. 2*a* and 2*b*) wherein the lock lever 22 permits the lock link 106 to move to the unlocked position, and a locked position (FIG. 2*c*) wherein the lock lever 118 moves the lock link 106 to the locked position. The lock lever 114 may be biased towards both the locked and unlocked positions by a suitable biasing member (not shown).

In the event of a vehicle crash while the lock link 106 is in the unlocked position, if a sufficiently large force or force component F is exerted in a selected direction shown by arrow 120 on the lock link pivot 116, the lock link 106 may be weighted in such a way that it rotates to its locked position (FIG. 2*c*). As a result, while the force F is acting on the lock link pivot 116, the inside and outside door release levers 110 and 112 are operatively disconnected from the pawl 104 reducing the likelihood of the vehicle door (not shown) being opened and a vehicle occupant being thrown from the vehicle.

If the lock link 106 is in the locked position (FIG. 2*c*) because the lock lever 114 is in the locked position during a crash event, then the outside and inside door release levers 110 and 112 are already disconnected from the pawl 104. However, the lock link 106 will remain in the locked position as long as the force F is present, even if during the crash event, crash-related forces move the lock lever 114 to its unlocked position. Thus, in the embodiment shown in FIGS. 2*a*-2*c*, the lock link 106 is itself also an inertia lever.

In the embodiment shown in FIGS. 2*a*-2*c*, the latch controller (not shown) may automatically lock the latch upon receiving a signal from a crash sensor that a crash event is taking place. However, such an operation may be too slow to prevent the vehicle door from opening during the initial moment of the crash event. By providing the inertia lever (which in the embodiment shown in FIG. 2, is in the form of the lock link 106), the vehicle door may be prevented from being opened by the forces present during the initial moment of the crash event, giving the latch controller sufficient time to lock the latch 100 thereby preventing the opening of the vehicle door even when the forces present are reduced to a level below the force F.

Figure 3A:
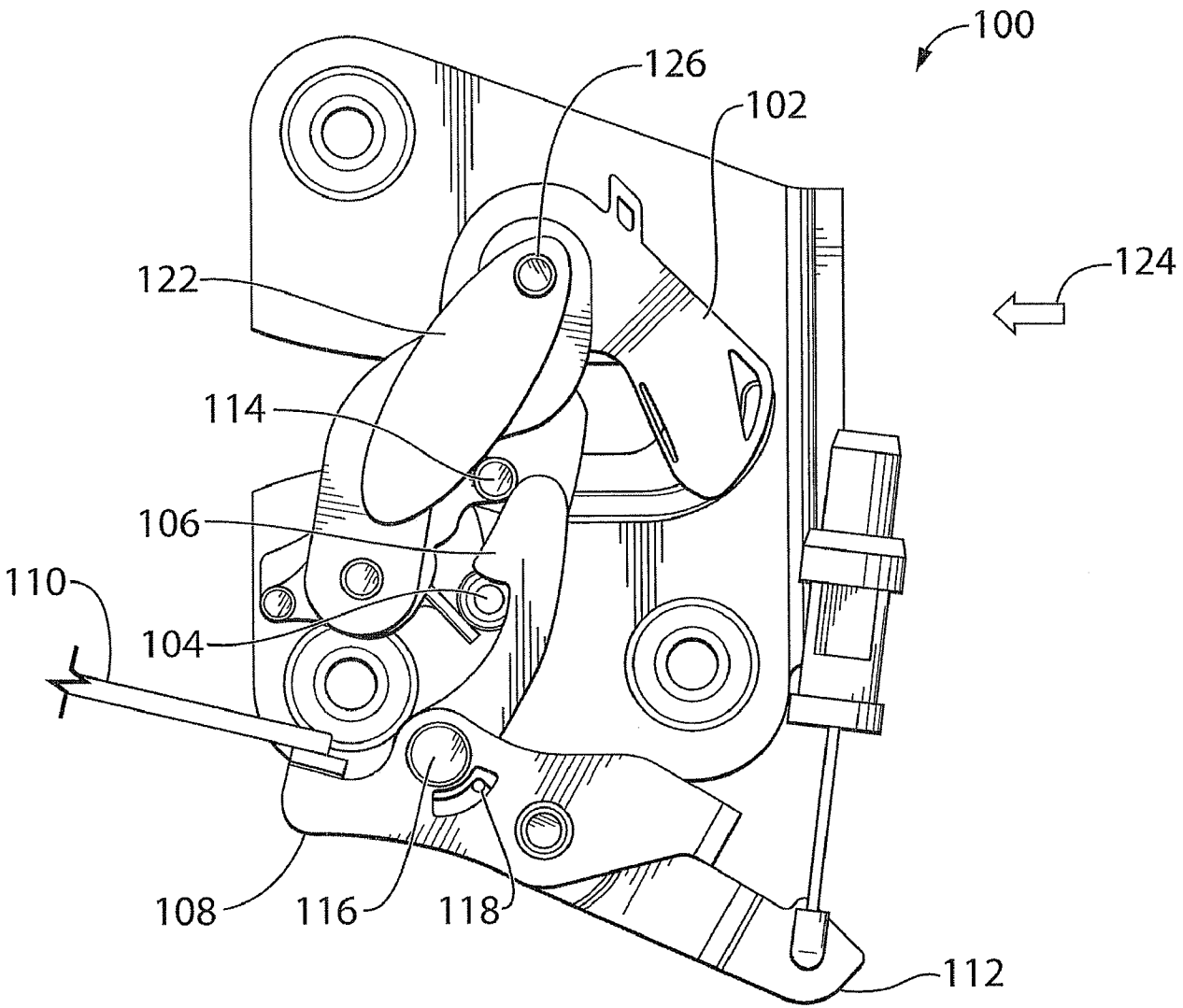
FIG. 3*a* is a plan view of a closure latch in accordance with yet another embodiment of the present invention, showing an inertia lever in a home position.
Figure 3B:
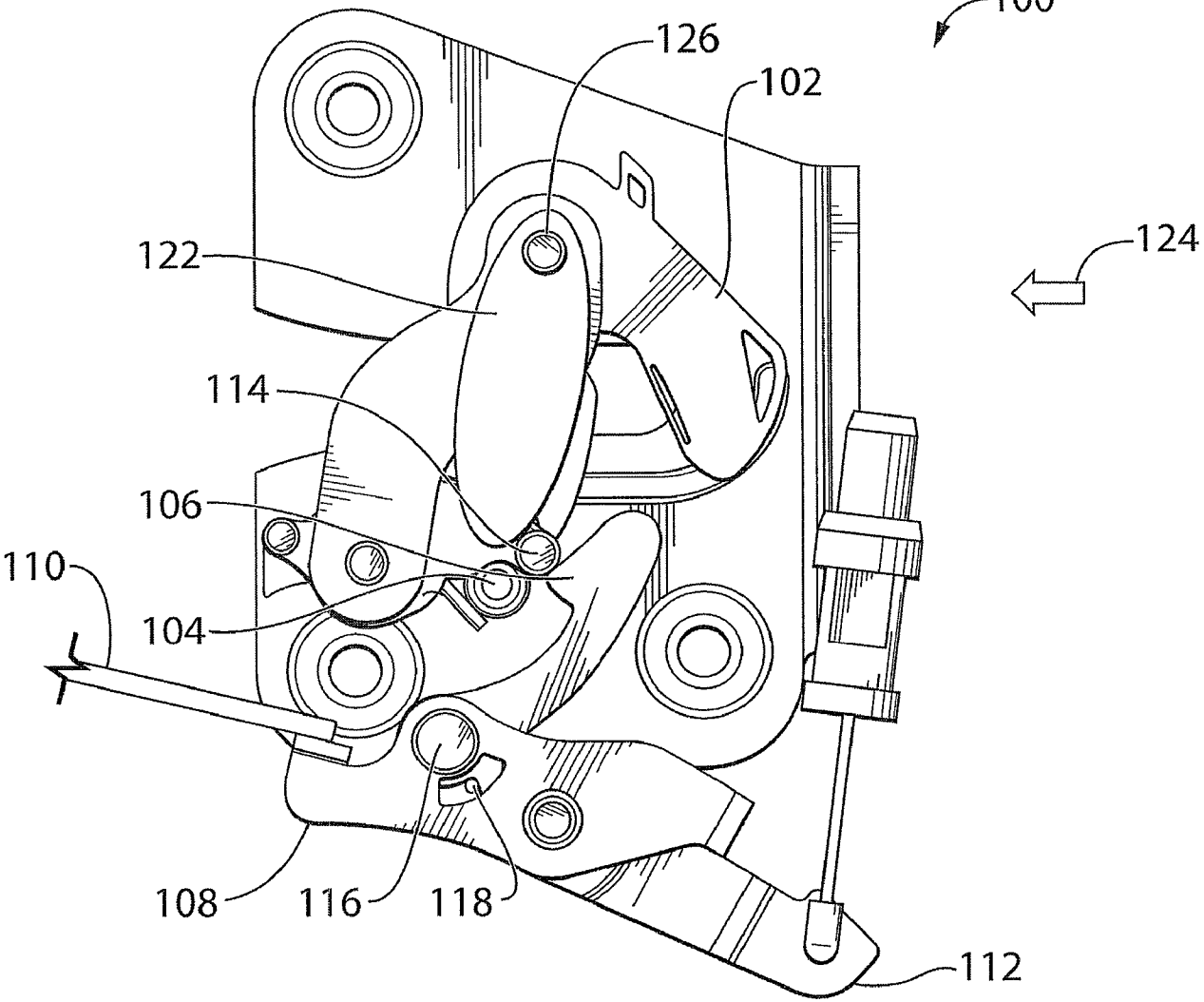
FIG. 3*b* is a plan view of the closure latch shown in FIG. 2*a*, showing the inertia lever in an actuated position.

Reference is made to FIGS. 3*a* and 3*b*, which shows the closure latch 100 with an optional separate inertia lever 122 that moves the lock link 106 from the unlocked position (FIG. 3*a*) to the locked position (FIG. 3*b*) during a crash event that generates a sufficient force F in a selected direction shown by arrow 124 on the inertia lever pivot shown at 126. The lock link 106 in the embodiment shown in FIGS. 3*a* and 3*b* may have a weight distribution that would not by itself move the lock link 106 to the locked position and/or hold it at the locked position for a suitable amount of time in the event of a crash. The inertia lever 122 however does have a weight distribution that causes it to rotate about its pivot 126, during such a crash event, to an actuated position which causes it to engage the lock lever 114 and move the lock lever 114 to the locked position in the event that the lock lever 114 is in the unlocked position, and to engage the lock link (through the lock lever 114) and to move the lock link 106 to the locked position in the event that the lock link 106 was in the unlocked position.

As a result of the arrangement shown in FIGS. 3*a* and 3*b*, the latch controller (not shown) may not be needed to lock the latch 100 during a crash event, because the lock lever 114 would have been moved by the inertia lever 122 to the locked position (FIG. 3*b*).

Optionally, after the crash event, the latch controller (not shown) may sense that the crash event is over and may move the lock lever 114 to the unlocked position shown in FIG. 3*a*.

The lock link biasing member 118 may move the inertia lever 122 to its home position while moving the lock link 106 to its unlocked position. Thus the lock link biasing member 118 may also be the inertia lever biasing member. It is optionally possible for the inertia lever 122 to have a dedicated biasing member of its own to urge it towards its home position.

It will be noted that the inertia lever 122 can only act to move the lock lever 114 from the unlocked position to the locked position. By contrast, when the inertia lever 122 moves back to its home position under the urging of the inertia lever biasing member 126 (or under the urging of other forces present during the crash event), it does not bring the lock lever 114 back to the unlocked position.

In the embodiment shown in FIGS. 3*a* and 3*b*, the lock lever 114 is moved by the inertia lever 122 to the locked position. It is alternatively possible for the inertia lever 122 to act directly on the lock link 106 and to permit the lock lever 114 to remain in the unlocked position during a crash event.

While the above description constitutes a plurality of embodiments of the present invention, it will be appreciated that the present invention is susceptible to further modification and change without departing from the fair meaning of the accompanying claims.

The invention claimed is:

1. A closure latch for a vehicle door, comprising:

a ratchet movable between an open position and a closed position;

a ratchet biasing member positioned to bias the ratchet towards the open position;

a pawl movable between a ratchet locking position wherein the pawl holds the ratchet in the closed position and a ratchet release position wherein the pawl permits the ratchet to move to the open position;

a pawl biasing member positioned to bias the pawl towards the ratchet locking position;

an inside door release lever movable between a home position wherein the inside door release lever permits movement of the pawl to the ratchet locking position, and a pawl release position wherein the inside door release lever moves the pawl to the ratchet release position;

an inside door release lever biasing member positioned to bias the inside door release lever towards the home position:

a lock link movable between an unlocked position wherein the lock link operatively connects an outside door release lever and the pawl, and a locked position wherein the lock link operatively disconnects the outside door release lever and the pawl;

a lock link biasing member positioned to bias the lock link towards the unlocked position;

a lock lever movable between a locked position wherein the lock lever moves the lock link to the locked position, and an unlocked position wherein the lock lever permits the lock link to move to the unlocked position;

a lock lever biasing member that is configured to bias the lock lever towards both the locked and unlocked positions;

an inertia member movable between a home position wherein the inertia member permits the lock link to be in the unlocked position, and an actuated position wherein the inertia member moves the lock link to the locked position, wherein the inertia member is movable to the actuated position by an actuation force that is at least a selected value acting in a selected direction on the vehicle door; and an inertia member biasing member positioned to bias the inertia member towards the home position;

wherein a crash event that generates the actuation force initiates movement of the inertia member to the actuated position and movement of the lock lever to the locked position;

wherein a reduction in force below the actuation force permits movement of the inertia member to the home position under bias by the inertia member biasing member, and wherein the lock lever remains in the locked position.

2. A closure latch for a vehicle door as claimed in claim 1, wherein the inertia member is an inertia lever that is pivotable about an inertia lever pivot.

3. A closure latch as claimed in claim 2, wherein the inertia lever is biased towards the home position by the lock link.

4. A closure latch as claimed in claim 2, wherein the lock link is movable by a lock link biasing member to the unlocked position after having moved to the locked position by the inertia lever.

5. A closure latch as claimed in claim 2, wherein the lock link is pivotable about a lock link pivot between the unlocked and locked positions.

6. A closure latch as claimed in claim 5, wherein the lock link and the inertia lever are the same component.

7. A closure latch as claimed in claim 1, wherein movement of the inertia lever to the actuated position moves the lock lever to the locked position.

8. A closure latch as claimed in claim 1, wherein the lock link in the locked position operatively disconnects the inside door release lever from the pawl.

9. A closure latch as claimed in claim 2, wherein the inertia lever is movable separately from the lock link.

10. A closure latch for a vehicle door, comprising:

a ratchet movable between an open position and a closed position;

a ratchet biasing member positioned to bias the ratchet towards the open position;

a pawl movable between a ratchet locking position wherein the pawl holds the ratchet in the closed position and a ratchet release position wherein the pawl permits the ratchet to move to the open position;

a pawl biasing member positioned to bias the pawl towards the locking position;

an inside door release lever movable between a home position wherein the inside door release lever permits movement of the pawl to the ratchet locking position, and a pawl release position wherein the inside door release lever moves the pawl to the ratchet release position;

an inside door release lever biasing member positioned to bias the inside door release lever towards the home position;

a lock link movable between an unlocked position wherein the lock link operatively connects an outside door release lever and the pawl, and a locked position wherein the lock link operatively disconnects the outside door release lever and the pawl;

a lock link biasing member positioned to bias the lock link towards the unlocked position;

an inertia member movable between a home position wherein the inertia member permits the lock link to be in the unlocked position, and an actuated position wherein the inertia member moves the lock link to the locked position, wherein the inertia member is movable to the actuated position by an actuation force that is at least a selected value acting in a selected direction on the vehicle door; and an inertia member biasing member positioned to bias the inertia member towards the home position;

wherein the inertia member is movable separately from the lock link.

11. A closure latch for a vehicle door, comprising:

a ratchet movable between an open position and a closed position;

a ratchet biasing member positioned to bias the ratchet towards the open position;

a pawl movable between a ratchet locking position wherein the pawl holds the ratchet in the closed position and a ratchet release position wherein the pawl permits the ratchet to move to the open position;

a pawl biasing member positioned to bias the pawl towards the locking position;

an inside door release lever movable between a home position wherein the inside door release lever permits movement of the pawl to the ratchet locking position, and a pawl release position wherein the inside door release lever moves the pawl to the ratchet release position;

an inside door release lever biasing member positioned to bias the inside door release lever towards the home position;

a lock link movable between an unlocked position wherein the lock link operatively connects an outside door release lever and the inside door release lever to the pawl, and a locked position wherein the lock link operatively disconnects the outside door release lever and the inside door release lever from the pawl;

a lock link biasing member positioned to bias the lock link towards the unlocked position;

an inertia member movable between a home position wherein the inertia member permits the lock link to be in the unlocked position, and an actuated position wherein the inertia member moves the lock link to the locked position, wherein the inertia member is movable to the actuated position by an actuation force that is at least a selected value acting in a selected direction on the vehicle door; and an inertia member biasing member positioned to bias the inertia member towards the home position.

* * * * *